US011222759B2

(12) United States Patent
Zuniga

(10) Patent No.: US 11,222,759 B2
(45) Date of Patent: Jan. 11, 2022

(54) ELECTRICAL SWITCH WITH ROCKER AND SMART IDENTIFICATION FEATURES

(71) Applicant: Melissa Zuniga, Brooklyn Park, MN (US)

(72) Inventor: Melissa Zuniga, Brooklyn Park, MN (US)

( * ) Notice: Subject to any disclaimer, the term of this patent is extended or adjusted under 35 U.S.C. 154(b) by 0 days.

(21) Appl. No.: 17/250,046

(22) PCT Filed: May 22, 2020

(86) PCT No.: PCT/US2020/034323

§ 371 (c)(1),
(2) Date: Nov. 12, 2020

(87) PCT Pub. No.: WO2020/237187

PCT Pub. Date: Nov. 26, 2020

(65) Prior Publication Data

US 2021/0296066 A1 Sep. 23, 2021

Related U.S. Application Data

(60) Provisional application No. 62/852,078, filed on May 23, 2019.

(51) Int. Cl.

| | |
|---|---|
| ***H01H 23/24*** | (2006.01) |
| ***H01H 23/02*** | (2006.01) |
| ***H01H 23/04*** | (2006.01) |

(52) U.S. Cl.

CPC ..... *H01H 23/025* (2013.01); *H01H 23/04* (2013.01); *H01H 23/24* (2013.01); *H01H 2221/016* (2013.01)

(58) Field of Classification Search

CPC .. H01H 2300/03; H01H 23/16; H01H 23/145; H01H 23/14; H01H 23/24;

(Continued)

(56) References Cited

U.S. PATENT DOCUMENTS

| | | | |
|---|---|---|---|
| 3,250,887 | A | 5/1966 | Sorenson |
| 3,928,743 | A | 12/1975 | Ohashi |

(Continued)

FOREIGN PATENT DOCUMENTS

| | | |
|---|---|---|
| DE | 3436172 A | 4/1986 |
| WO | WO2019213523 | 11/2019 |

OTHER PUBLICATIONS

Application and File History for U.S. Appl. No. 17/250,018, filed Nov. 3, 2020, Inventor Melissa Zuniga.

(Continued)

*Primary Examiner* — Ahmed M Saeed

(74) *Attorney, Agent, or Firm* — Patterson Thuente Pedersen, P.A.

(57) ABSTRACT

An electrical switch with identifying features. Embodiments include an electrical switch that comprises a rocker that is pivotable between a first position and a second position such that the electrical circuit is energized when the rocker is in the first position and deenergized when the rocker is in the second position, a cover arranged within the rocker such that a front surface of the cover is viewable by a user; an interchangeable label arrangeable a rear surface of the cover, a light pipe arrangeable proximate a rear surface of the interchangeable label, and an illuminating element. In embodiments, the electrical switch may include a tactile switch arranged proximate a rear surface of the light pipe, such that the tactile switch can be activated by an application of rearward pressure to the cover.

7 Claims, 13 Drawing Sheets

(58) Field of Classification Search
CPC ..... H01H 23/04; H01H 23/12; H01H 23/02; H01H 23/025; H01H 23/06; H01H 23/205; H01H 23/143; H01H 23/30; H01H 23/28; H01H 23/141; H01H 23/003; H01H 21/025; H01H 21/36; H01H 23/162; H01H 13/83; H01H 13/023; H01H 2219/036; H01H 2219/039; H01H 13/86; H01H 2013/026; H01H 9/182; H01H 2219/002
See application file for complete search history.

(56) References Cited

U.S. PATENT DOCUMENTS

| | | | |
|---|---|---|---|
| 4,234,774 | A | 11/1980 | Paparella |
| 5,008,503 | A | 4/1991 | Stuhlmacher |
| 6,013,885 | A | 1/2000 | Kowalczyk |
| 7,329,018 | B2 | 2/2008 | Yu et al. |
| 8,253,049 | B2 | 8/2012 | Grisby |
| 8,338,731 | B2 | 12/2012 | Yu |
| 8,592,681 | B2 | 11/2013 | Alderson et al. |
| 8,822,859 | B2 | 9/2014 | Hoffman et al. |
| 9,082,569 | B2 | 7/2015 | Alderson et al. |
| 10,607,797 | B2 | 3/2020 | Zuniga |
| 2004/0218379 | A1 | 11/2004 | Barton |
| 2007/0216318 | A1 | 9/2007 | Altonen et al. |
| 2010/0170773 | A1 | 7/2010 | Grisby |
| 2014/0097070 | A1 | 4/2014 | McDonnell |
| 2014/0151203 | A1 | 6/2014 | Gouhl et al. |
| 2014/0265883 | A1 | 9/2014 | Mortun |
| 2016/0035508 | A1 | 2/2016 | Murata |
| 2018/0137999 | A1 | 5/2018 | Zuniga |
| 2019/0074676 | A1 | 3/2019 | Beghelli |

OTHER PUBLICATIONS

International Search Report and Written Opinion, International Application No. PCT/US2020/034323, dated Aug. 19, 2020, 13 pages.
Application and File History for U.S. Appl. No. 15/813,822, filed Nov. 15, 2017, Inventor Melissa Zuniga.
International Search Report and Written Opinion, International Application No. PCT/US2019/030603, dated Jul. 17, 2018, 12 pages.

ELECTRICAL SWITCH WITH ROCKER AND SMART IDENTIFICATION FEATURES

CROSS-REFERENCE TO RELATED APPLICATIONS

This application is a national stage entry of International Application No. PCT/US2020/034323, filed May 22, 2020, which claims the benefit of U.S. Provisional Application No. 62/852,078, filed May 23, 2019, the disclosure of which is incorporated by reference herein.

TECHNICAL FIELD

Embodiments of the present disclosure relate generally to the field of electrical switches, specifically electrical switches adapted for use in building wiring.

BACKGROUND

In many building environments, lights, electrical outlets, and other devices are controlled by a series of electrical switches, often referred to as "light switches." For convenience, these switches are often arranged on panels with two or more switches in close proximity. Individual switches on panels are often generic, leading to user confusion regarding which electrical device(s) are controlled by any particular switch.

A variety of labeling options for switch plates exist, ranging from permanently labeled plates to removable adhesive labels. However, in many environments, switch plate designs are decorative, and labels incorporated into switch plates can be intrusive.

A need exists therefore, for electrical switches that enable identification of the electrical device(s) and/or circuits that they are configured to control.

SUMMARY

Embodiments of the present disclosure include light switches with identifying labeling. In embodiments, a user facing surface of an electrical switch includes an identifying symbol on an interchangeable tile or display. The electrical switch can have an actuation portion that is a toggle or a rocker.

In one aspect of the present disclosure, an electrical switch to control an electrical circuit may include a switch body including a first terminal for electrical connection to a first lead of the electrical circuit and a second terminal for electrical connection to a second lead of the electrical circuit, a rocker pivotable between a first position and a second position such that the electrical circuit is energized when the rocker is in the first position and deenergized. The rocker can be rocker is pivotable between a first position and a second position such that the electrical circuit is energized when the rocker is in the first position and deenergized when the rocker is in the second position, the rocker defining an aperture. The switch may further include a cover arranged within the aperture such that a front surface of the cover is viewable by a user, an interchangeable label arrangeable proximate a rear surface of the cover, a light pipe arrangeable proximate a rear surface of the interchangeable label, and an illuminating element.

In embodiments, the electrical switch may include a tactile switch arranged proximate a rear surface of the light pipe, such that the tactile switch can be activated by an application of rearward pressure to the cover. The illuminating element may include a tri-color red-green-blue (RGB) light-emitting diode (LED).

In embodiments, the switch can include a controller in electrical communication with the tactile switch and the LED and configured to change a display state of the LED in response to activation of the tactile switch. Changing the display state of the LED can comprise one or more of changing a color of the LED, changing a light intensity of the LED, or changing a flash rate of the LED.

In embodiments, the interchangeable label comprises a user-comprisable identifier on a front surface of the interchangeable label, such that the interchangeable label indicates a property of the electrical circuit controlled by the electrical switch.

In embodiments, the switch can further comprise a conductive trace electrically coupling the illuminating element to the electrical circuit controlled by the electrical switch, such that the illuminating element is powered by the electrical circuit. In embodiments, a power source independent of the electrical circuit can be provided, such that the illuminating element is powered by the power source.

In embodiments, the interchangeable label can at least partially comprise a light-transmitting material, such that a light generated by the illuminating element can be seen at a front surface of the interchangeable label. In embodiments, the rocker can comprise an opaque material, such that a light generated by the illuminating element cannot be seen through the rocker.

In an aspect of the present disclosure, an electrical switch to control an electrical circuit can comprise a switch body including a first terminal for electrical connection to a first lead of the electrical circuit and a second terminal for electrical connection to a second lead of the electrical circuit; a rocker pivotable between a first position and a second position such that the electrical circuit is energized when the rocker is in the first position and deenergized when the rocker is in the second position, an interchangeable label arrangeable proximate a rear surface of the rocker, a light pipe arrangeable proximate a rear surface of the interchangeable label, and a plurality of illuminating elements.

In embodiments, each of the plurality of illuminating elements comprises a tri-color light-emitting diode (LED). In embodiments a controller can be in in electrical communication with each of the illuminating elements. The controller can be configured to change a display state of at least one illuminating element of the plurality of illuminating elements in response to a signal received via a communication interface, such as a wireless interface.

In another aspect of the present disclosure, a kit for providing an indication of a function of an electrical switch can include a plurality of interchangeable labels and an electrical switch to control an electrical circuit. The electrical switch can comprise a switch body including a first terminal for electrical connection to a first lead of the electrical circuit and a second terminal for electrical connection to a second lead of the electrical circuit, a rocker pivotable between a first position and a second position such that the electrical circuit is energized when the rocker is in the first position and deenergized when the rocker is in the second position, the rocker defining an aperture, an illuminating element. a cover arranged within the aperture such that a front surface of the cover is viewable by a user, and a light pipe. Each interchangeable label of the plurality of interchangeable labels can be removably arrangeable between the cover and the light pipe.

In another aspect of the present disclosure, a kit for providing an indication of a function of an electrical switch can include a plurality of interchangeable labels and an electrical switch to control an electrical circuit. The electrical switch can comprise a switch body including a first terminal for electrical connection to a first lead of the electrical circuit and a second terminal for electrical connection to a second lead of the electrical circuit, a rocker pivotable between a first position and a second position such that the electrical circuit is energized when the rocker is in the first position and deenergized when the rocker is in the second position, a light pipe, and a plurality of illuminating elements. Each interchangeable label of the plurality of interchangeable labels can be removably arrangeable between the rocker and the light pipe.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures.

Figure 1A:
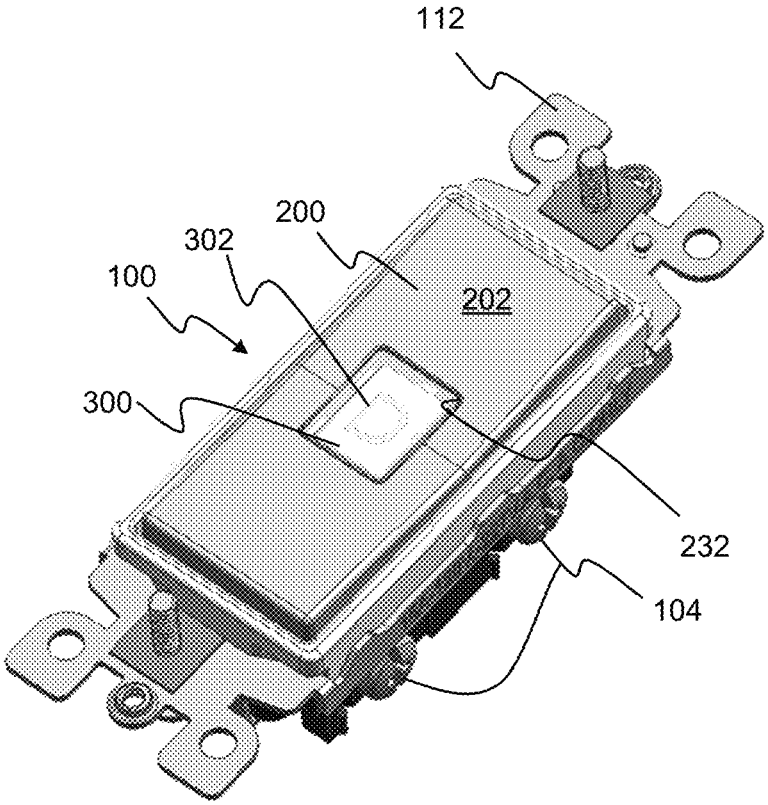
FIG. 1A is a perspective view depicting a rocker switch, according to an embodiment.
Figure 1B:
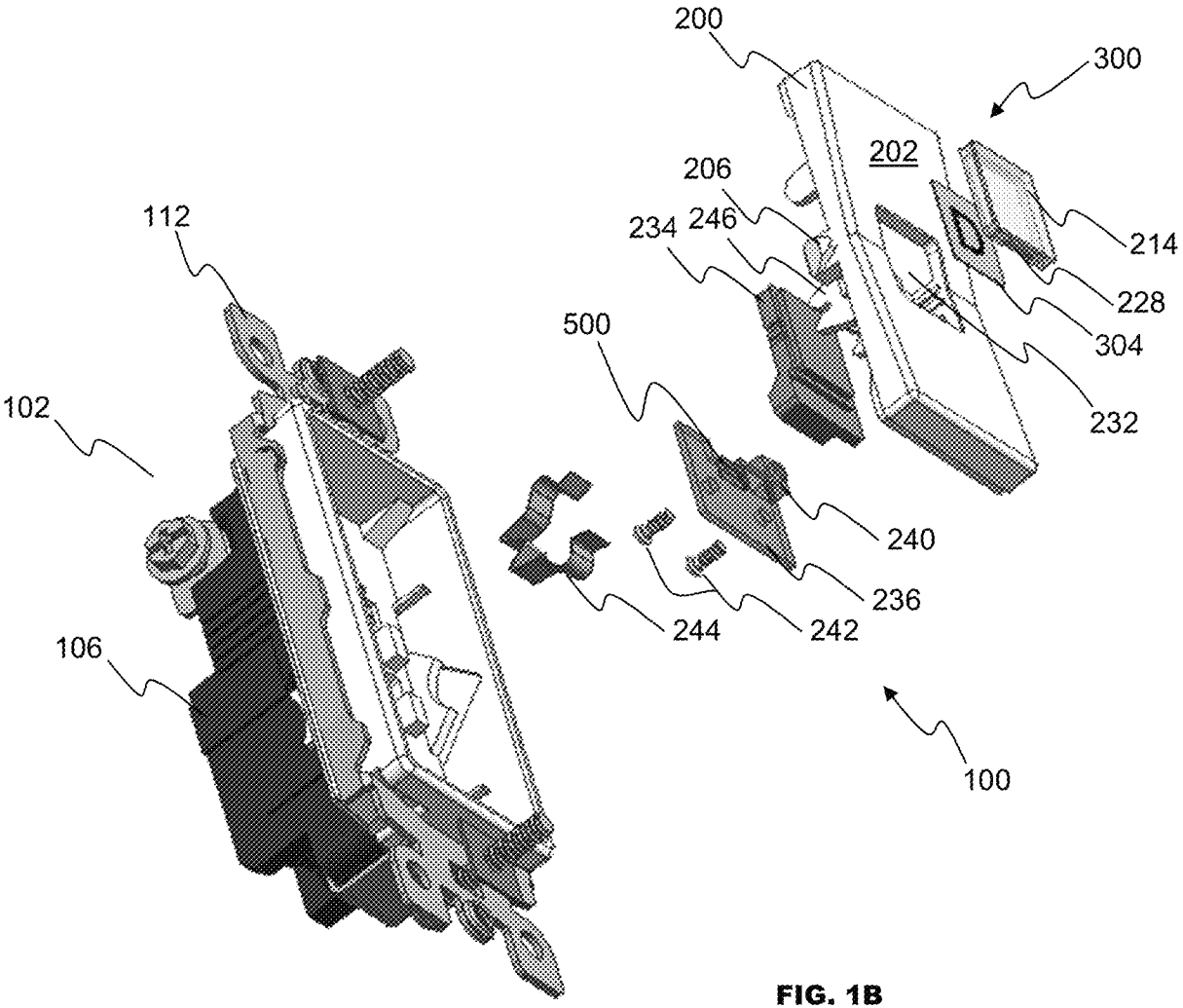
FIG. 1B is an exploded perspective view depicting components of the rocker switch of FIG. 1A.
Figure 1C:
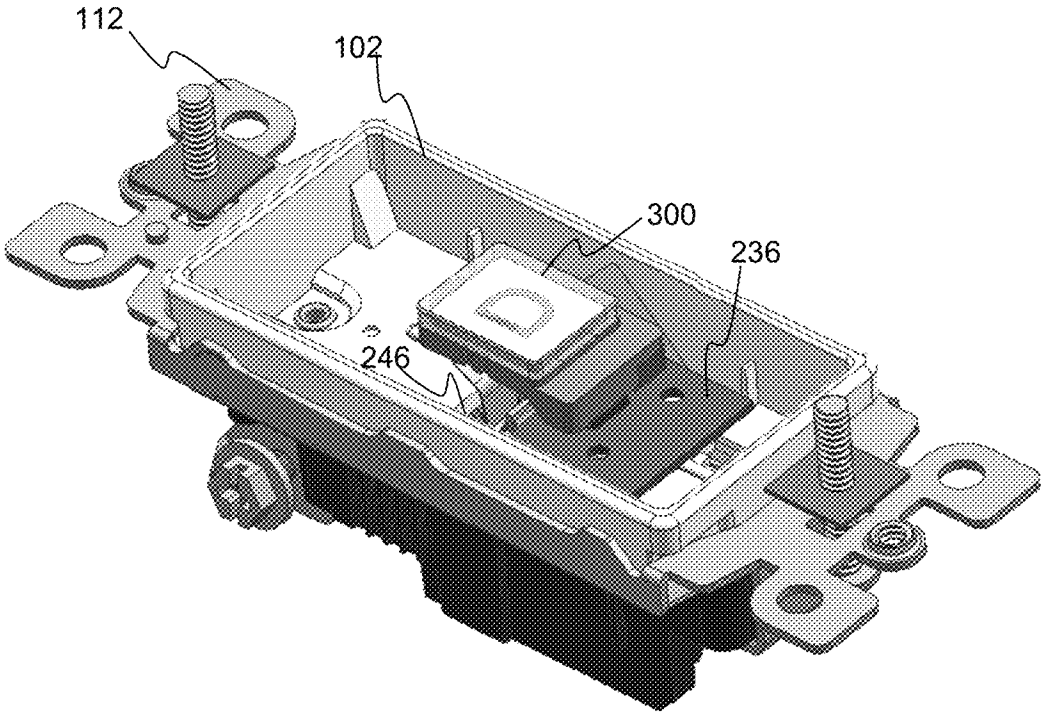
FIG. 1C is an exploded perspective depicting components of the rocker switch of FIG. 1A.
Figure 1D:
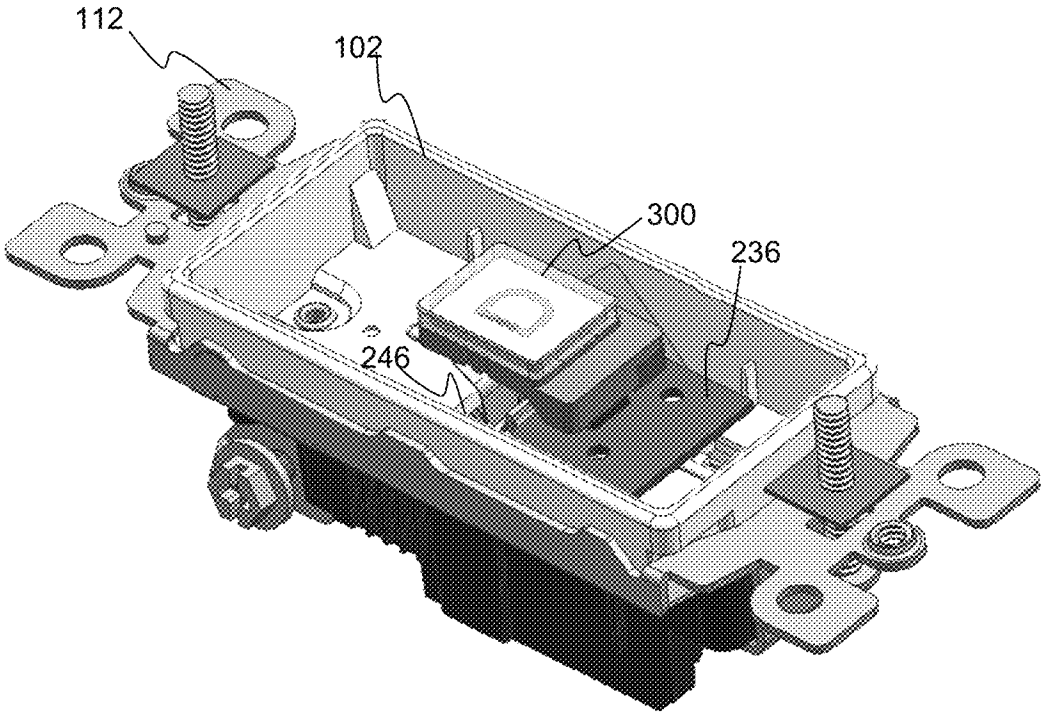
FIG. 1D is a perspective view depicting components of the rocker switch of FIG. 1A.
Figure 1E:
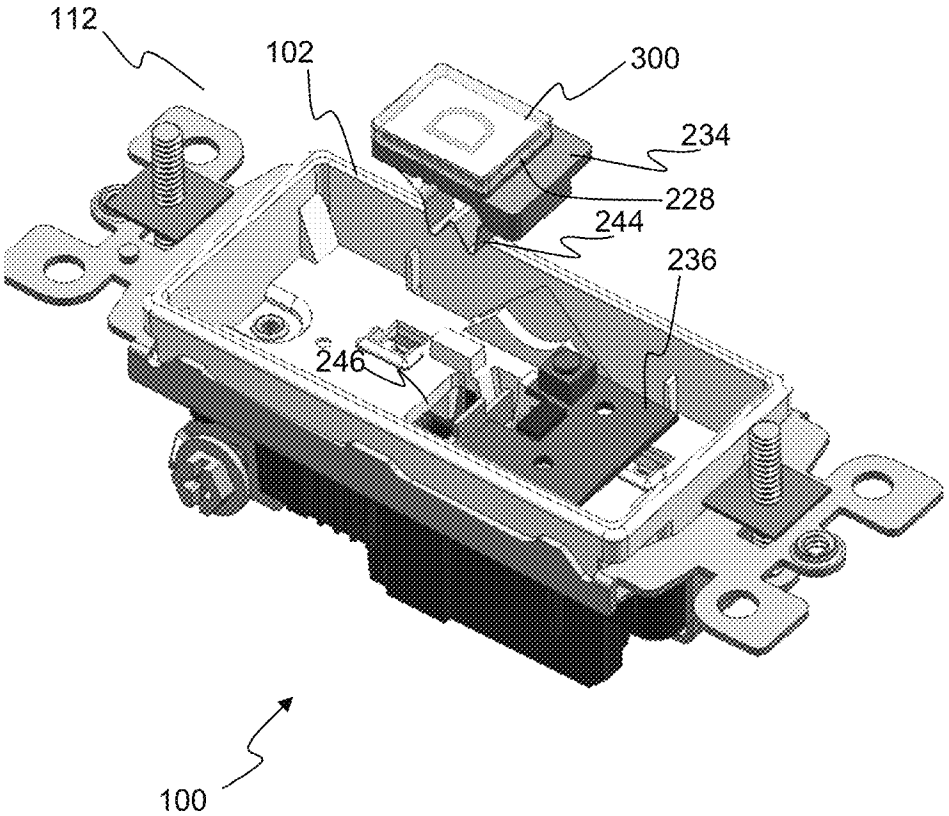
FIG. 1E is an exploded perspective view depicting components of the rocker switch of FIG. 1A.
Figure 1F:
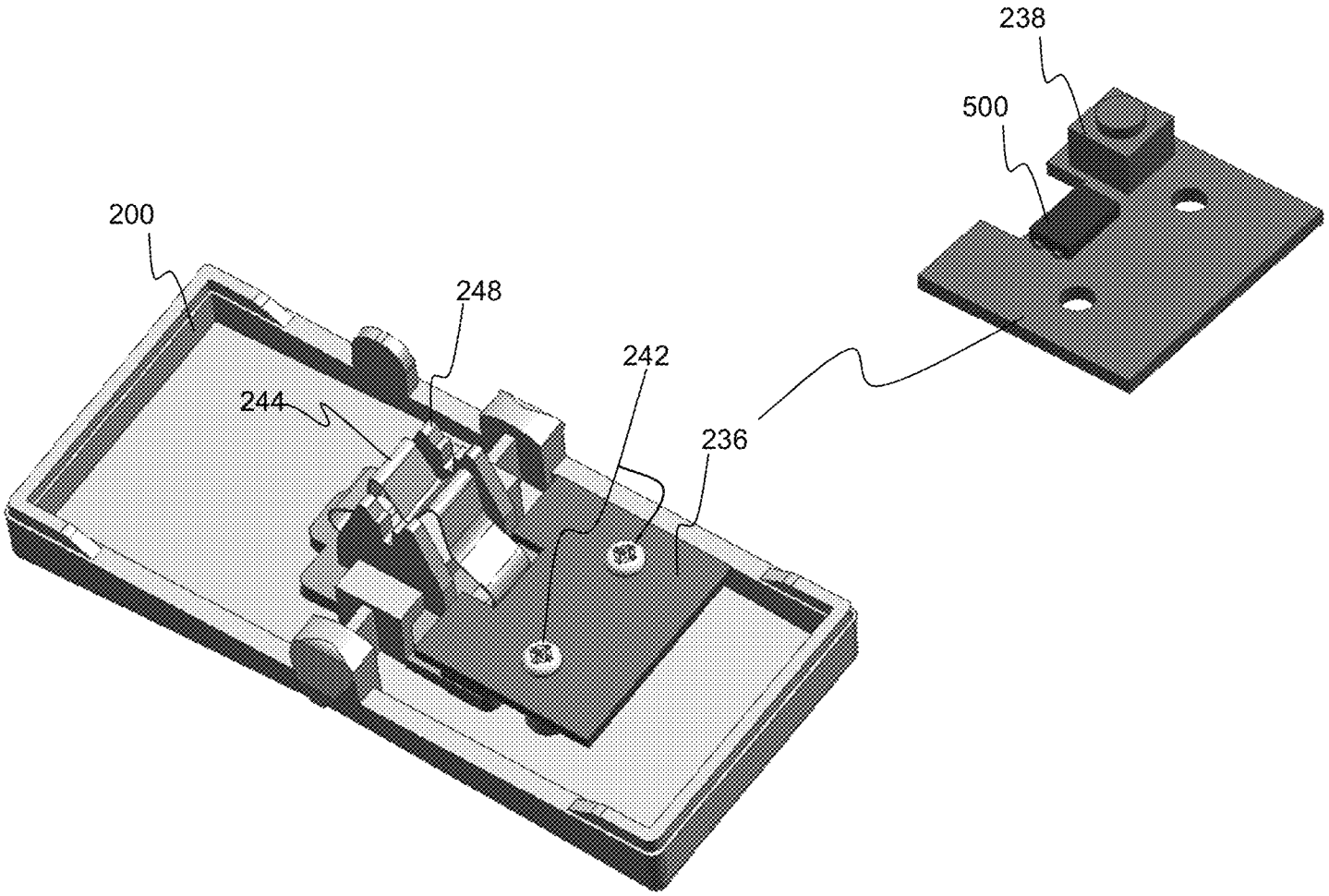
FIG. 1F is an exploded perspective view depicting components of the rocker switch of FIG. 1A.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

FIG. 1A is a perspective view of an embodiment of an electrical switch 100. Electrical switch 100 includes rocker 200, which is operably coupleable to interchangeable tile assembly 300. In embodiments. tile assembly 300 and rocker 200 can be combined into a rocker assembly. Electrical switch 100 can enable a user to control an electrical circuit via manipulation of rocker 200. In embodiments, the electrical circuit can include one or more lighting devices, electrical outlets, other devices, or combinations of these. Various embodiments of switches, rockers, rocker assemblies, toggles, toggle assemblies and other components are depicted herein. Similar reference numbers are used to refer to similar component across the various embodiments. As described herein, references to a rear, rearward, or back end or surface of a component generally indicate the direction away from the user when switch 100 or other components are installed. In other words, the "rear" can be considered to be the direction toward the wall when switch 100 is installed in a wall. Further, references to a "front" or "forward" direction are intended to refer to the direction facing away from the wall toward the user when the switch is installed.

Switch 100 can comprise switch body 102. Switch body 102 can have form, dimensions, materials, and structure similar to conventional electrical switches capable of receiving rocker 200. Switch body 102 can comprise two or more terminals 104 for connection to leads of an electrical circuit. Switch 100 can be a single-pole light switch including two terminals 104 for connection to electrical wiring. Embodiments of switch 100 can be three-way or four-way switches, and may include more terminals 104, including one or more grounding terminals in order to support environments in which multiple switches may control an electrical circuit.

FIGS. 1B-1H are views depicting switch 100 and its various components, according to an embodiment. In the depicted embodiment, switch body 102 further comprises housing 106, contact assembly 108, guard plate 110 and mounting plate 112. In embodiments, switch body 102 can have dimensions according to those depicted in FIGS. 2A and 2B. Those of ordinary skill in the art will appreciate that the configuration of switch body 102 depicted and described herein is a particular example, and various alternative configurations can be used, especially those adapted to applicable local electrical standards or codes.

Guard plate 110 can comprise pivot cradles 114. Contact assembly 108 can comprise contact mechanism 108*a* to selectively electrically couple one or more terminals 104. In an embodiment, contact mechanism 108*a* can comprise a lever arm 108*b*. Lever arm 108*b* can be spring-loaded, flexible, or otherwise manipulable such that inward pressure on lever arm 108*b* can break contact between lever arm 108*b* and terminal 104. Contact assembly can further comprise a spring (not shown). Those of ordinary skill in the art will recognize that other configurations of contact assembly 108 can be used.

Rocker 200 can comprise user-operable actuator portion (or simply, actuator) 202. Rocker 200 can further comprise one or more pivot pins 206, enabling a front end of rocker 200 to pivot in an arc (centered at pivot pins 206) from a first position to a second position within switch body 102 by movement of user-operable actuator portion 202. Rocker 200 can further comprise one or more features, such as a ram, button, piston, protrusion, or other, configured to selectively engage a contact assembly 108 of switch body 102. User-operable actuator portion 202 can comprise aperture 232 to receive interchangeable tile assembly 300.

Tile assembly 300 can comprise accessory board 236, light pipe 234, interchangeable label 304, and cover 214. Accessory board 236 can be a printed circuit board assembly (PCBA) comprising illuminating element 500. In embodiments, accessory board 236 can further comprise tactile switch 238. Interchangeable label 304 can comprise a label, sticker, decal, or other interchangeable decorative element. Interchangeable label 304 can be partially transparent or translucent to enable transmission of light through user-comprisable identifier 302. Label 304 can comprise one or more adhesive surfaces and be removable coupleable to light pipe 234 and/or cover 214. In other embodiments, label 304 can be simply arrangeable between light pipe 234 and cover 214 without further fixation.

Interchangeable tile assembly 300 can be removably coupleable to user-operable actuator portion 202. Interchangeable tile assembly 300 can comprise a user-comprisable identifier 302 on a label 304. User-comprisable identifier 302 is depicted as the letter "D" herein, but can comprise, any letter, number, character, pictogram, icon, other symbol, pattern, color, or other marker or identifier capable of assisting in identification. In embodiments, tile assembly 300 can comprise a material that temporarily or permanently markable with various substances including permanent ink, dry-erase ink, chalk, graphite, crayon, or other mark-making material.

In embodiments, tile assembly 300 can present a square or rectangular cross section, with a length and width between about 13 mm and about 16 mm. In embodiments, tile assembly 300 can present a cross section of alternative shape or dimensions, including a shape coordinated with the front end of rocker 200. Tile assembly 300 can have a rear surface configured to correspond to the front end of rocker 200.

In embodiments, identifier 302 can be molded into tile assembly 300. Identifier 302 can be raised into a high relief or sunken into bas-relief relative to label 304, in embodiments. In embodiments, identifier 302 may present as an aperture or bore extending from a front surface to a rear surface of label 304. Identifier 302 can further comprise a translucent or transparent portion of label 304, such that light can be transmitted through identifier 302.

Figure 1G:
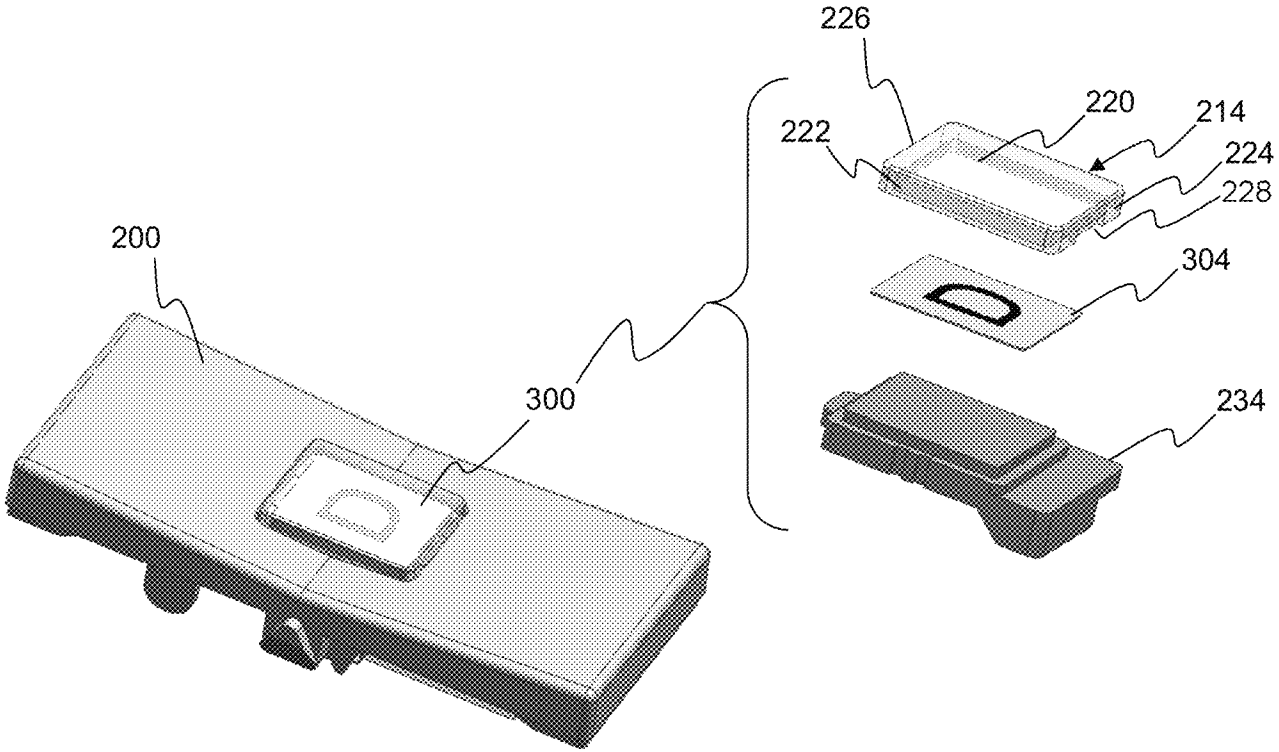
FIG. 1G is a perspective view depicting components of the rocker switch of FIG. 1A.
Figure 1H:
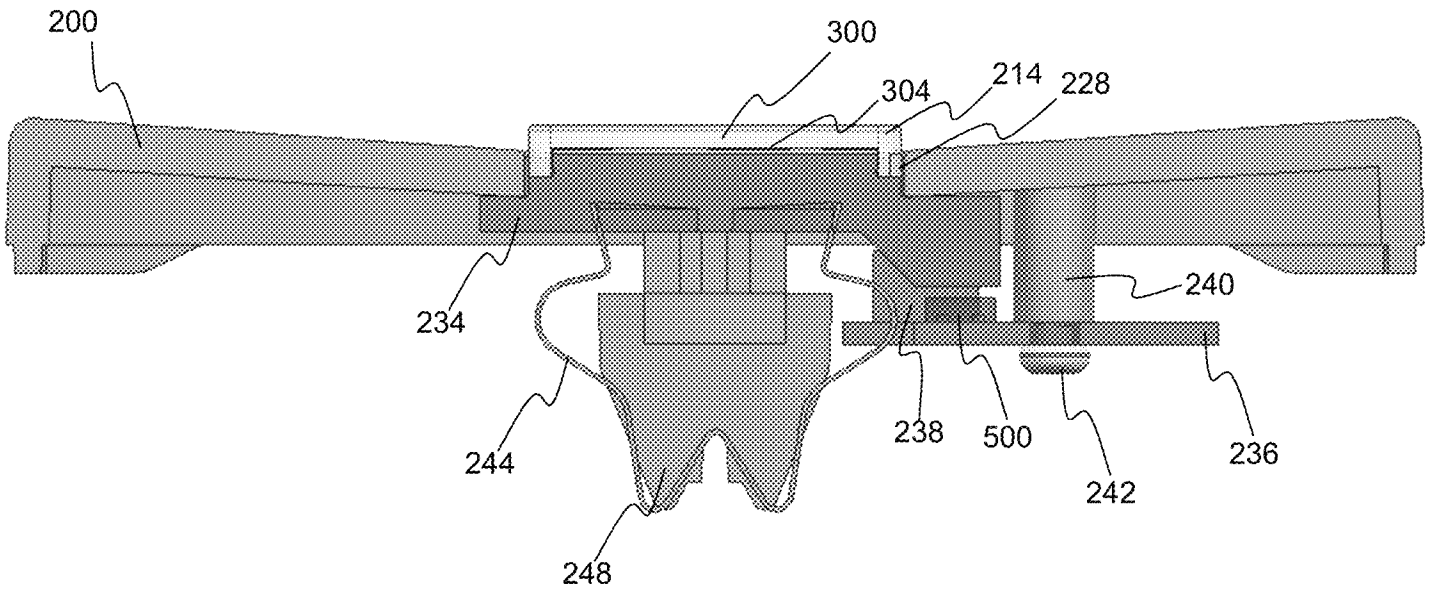
FIG. 1H is a partial section view depicting components of a rocker switch, according to an embodiment.
Figure 2B:
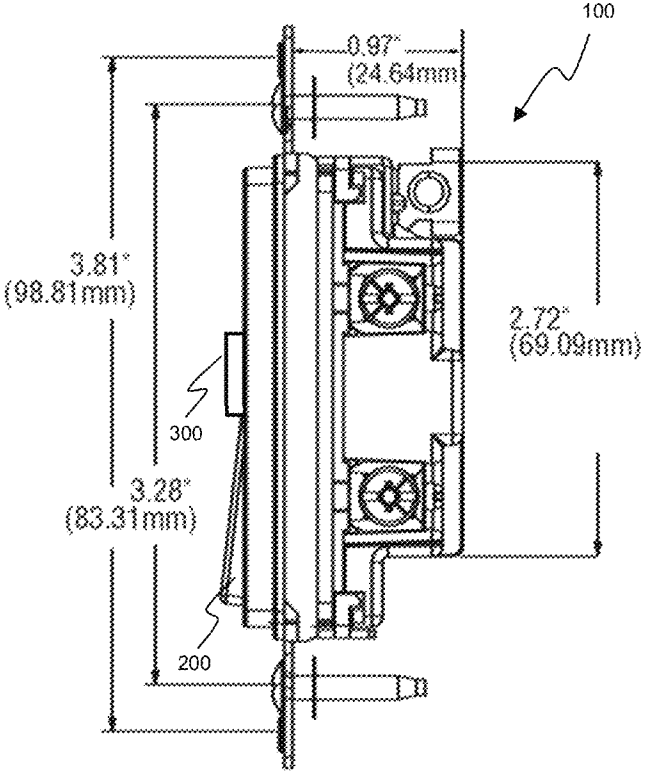
FIG. 2B is a side plan view depicting a rocker switch, according to an embodiment.
Figure 2A:
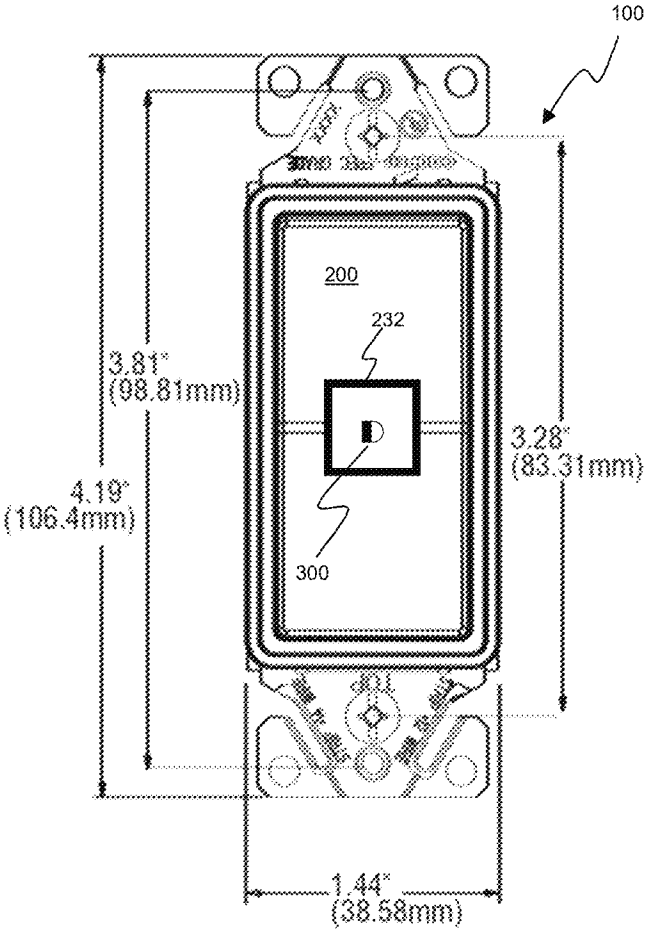
FIG. 2A is a front plant view depicting a rocker switch, according to an embodiment.

Cover 214 can comprise a transparent or translucent material and be arrangeable proximate label 304 opposite from light pipe 234 when switch 100 is in use. Label 304 can therefore be arranged or sandwiched between cover 214 and light pipe 234. As depicted in FIG. 1G, cover 214 can comprise a front surface 220, side surfaces 222, bottom surface 224 and top surface 226. Cover 214 can comprise flanges, grooves, or other structures configured to slidably engage with light pipe 234.

In embodiments, cover 214 can be formed from a singular translucent or transparent material. In other embodiments, each surface of cover 214 can comprise a different material. Front surface 220 can comprise a translucent or transparent material. In embodiments, each of side surfaces 222, bottom surface 224 and top surface 226 can comprise the same material as front surface 220. Any of side surfaces 222, bottom surface 224 and top surface 226 can comprise alternative materials, including opaque materials. For example, in an embodiment, only front surface 220 enables transmission of light from behind cover 214. In embodiments, front surface 220 can be angled relative to bottom surface 224 and top surface 226, such that identifier 302 can be more easily seen by a user regardless of the angle of the rocker 200. Front surface 220, for example, can be arranged at an angle of about 120° relative to top surface 226.

Cover 214 can further comprise slot 228, defined in bottom surface 224. Slot 228 can be configured enable insert of a finger, tool, or other device to facilitate a prying action to remove cover 214 from light pipe 234. In embodiments, slot 228 can comprise an angled depression in bottom surface 224.

Light pipe 234 can comprise a translucent or transparent material. In embodiments, light pipe 234 can comprise optical grade materials such as optical acrylic or polycarbonate. Light pipe 234 can be arranged proximate illuminating element 500 such that light emitted from illuminating element 500 can be transmitted to label 304 and cover 214. Light pipe 234 can comprise one or more flanges, grooves, slots, or other structures enabling cover 214 to be removably coupled to light pipe 234.

Accessory board 236 can draw power from an independent battery or other power source in embodiments. In embodiments, accessory board 236 can be electrically coupled to terminals 104 by one or more conductive traces (not shown) to draw power from the circuit controlled by switch. Accessory board 236 can be removably coupled to rocker 200 by one or more fasteners 242. Fasteners 242 can comprise screws, clips, nails, or other fastening mechanisms. Each fastener 242 can be coupled to a standoff 240. Accessory board 236 can comprise illuminating element 500 which can be a light-emitting diode (LED) or other light source capable of generating light without causing excess power draw or heating of switch 100. Illuminating element 500 can further comprise a circuit board including power terminals and LED.

Figure 3:
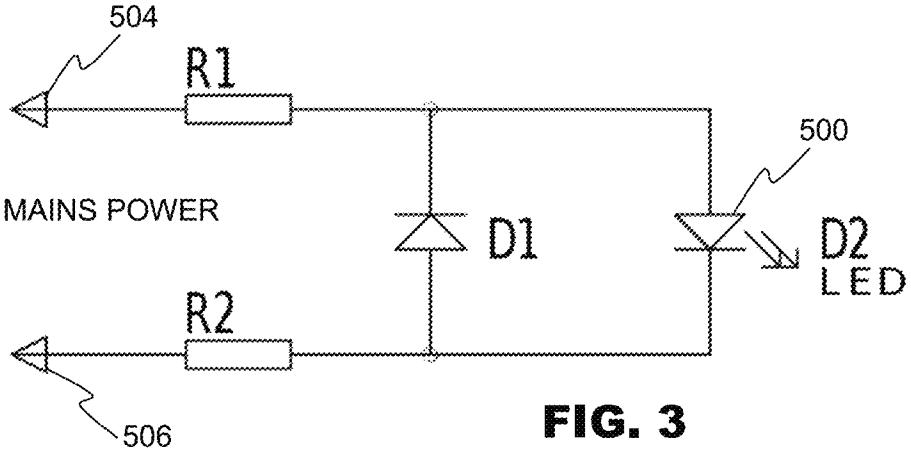
FIG. 3 is a schematic view depicting an electrical architecture of an illuminating element, according to an embodiment.

FIG. 3 depicts a wiring diagram of a circuit that can be provided on accessory board 236, according to one embodiment. Each of terminals 504 and 506 can be connectable to mains power, for example, a 120V alternating current (AC) line, though other mains power configurations can be supported by embodiments. Each of terminals 504 and 506 can be electrically coupled to one of resistors R1 and R2, which can be 162 Ω, 0.25 W resistors with 0.5% tolerance, in one embodiment. Illuminating element 500 can be an LED, electrically coupled to diode D1, which can be a 1 kV recovery rectifier diode, such as a 1N4007 diode in one embodiment. Illuminating element 500 can comprise a 3.2V LED in embodiments.

In embodiments, illuminating element 500 can comprise a multi-element LED, such as the tri-color or red-green-blue (RGB) LEDs described in U.S. Pat. No. 8,339,058 to Simmers, or other light source capable of emitting light of various colors. In embodiments, illuminating element 500 can be factory configured to display a specific color.

In embodiments, switch 100 can include a configuration mechanism adapted to enable user selection of the color or intensity of illuminating element 500. In an embodiment, the configuration mechanism can comprise one or more switches, dials, or jumpers, enabling a user to determine whether illuminating element 500 will be illuminated, and if so the relative intensity of each element of a multi-element LED in order to determine the color. In an embodiment, the configuration mechanism can comprise a wired or wireless connection to a control device (such as a computer, mobile phone, table, remote control, or other device) adapted to send control signals that are interpreted by configuration mechanism to modify the operating parameters of illuminating element 500.

In embodiments, the configuration mechanism can comprise tactile switch 238 and spring 244. Tactile switch 238 can comprise a momentary, push-button, or other switch. Tactile switch 238 can be arranged on, and electrically connected to accessory board 236. Tactile switch 238 can be arranged proximate to and behind light pipe 234, such that when light pipe 234 is pushed backward towards guard plate 110, for example, by compressive force applied to cover 214 and transferred to light pipe 234, tactile switch 238 is engaged. Spring 244 can be arranged in bore 246 of guard plate 110 such than when the compressive force is relieved, light pipe 234 and cover 214 are urged forward to an original position.

Figure 4:
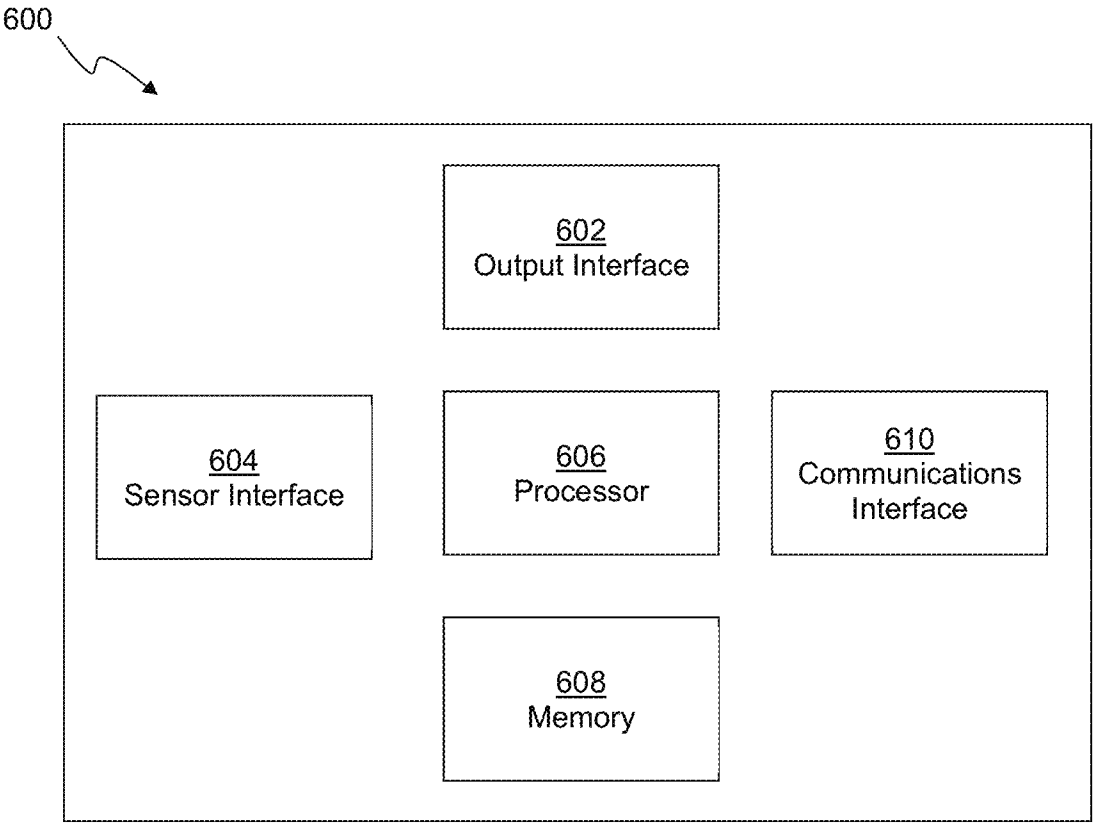
FIG. 4 is a schematic view depicting a controller, according to an embodiment.

FIG. 4 is a schematic view depicting a controller 600, according to an embodiment. Controller 600 can be arranged on, or communicably coupled to, accessory board 236. Controller 600 can comprise an output interface 602 that can be electrically coupled to illuminating element 500. Controller 600 can further comprise a sensor interface 604 that can be communicably coupled to tactile switch 238. In use, activation of tactile switch 238 can provide an electrical signal to controller 600, which will cause controller 600 to toggle output interface 602 between a plurality of display states.

Each display state of output interface 602 can comprise electrical signals causing illuminating element 500 to be illuminated in on or more ways. In various embodiments, the display states can involve varied illumination intensity, color, and flashing (on/off) behavior. A variety of display states that could be supported in one embodiment are provided in Table 1 below.

TABLE 1

| Display state | Intensity | Color | Flash |
|---|---|---|---|
| S1 | Off (0%) | N/A | N/A |
| S2 | On (100%) | Red | No |
| S3 | On (50%) | Red | No |
| S4 | On (100%) | White | 1 second |
| S5 | On (100%) | Violet | 2 second |

Per table 1, in a first display state S1 illuminating element can be off. In a second display state S2 illuminating element 500 can be on at full intensity displaying a red color. In a third display state S3 illuminating element 500 can be on at half intensity displaying a red color. In a fourth display state S4 illuminating element 500 can alternate between being off and displaying a white color at full intensity in 1 second intervals. In a fifth display state S5, illuminating element 500 can alternate between being off and displaying a violet color at full intensity at 2 second intervals. The embodiment summarized in Table 1 is provided only as an example, and other combinations and configurations of display states are possible, such as alternating between intensities or colors, or rotating between a plurality of intensities and colors. In embodiments, display states can be hardwired, hard-coded, or programmed into controller 600. In alternate embodiments, as described with reference to smart switch embodiments below, display states can be stored in memory 608, and configured via communications interface 610.

In embodiments, illuminating element 500, light pipe 234, and/or cover 214 can be replaced by a screen (not shown). The screen can be an LED, LCD, OLED or other display screen configured to be affixed at a front end of rocker 200 and incorporated into embodiments of switch 100. The screen can, in embodiments, be communicatively coupled to controller 600 via output interface 602.

Components of controller 600 can be provided separately, or can be incorporated into a single microcontroller module, such as a SS8 Series 1 microcontroller. The microcontroller can have a hardware design that includes eight low-side outputs, three analog/digital inputs and also two serial communication ports for Modbus RS-485 and CAN bus. The microcontroller can include communication interface 610 with IOT (Internet of Things) capabilities through hardware or software Wi-Fi, Bluetooth, z-wave, or other communications engines.

Memory 608 can be configured to store a plurality of symbols, letters, colors, or patterns that can be displayed on a screen via output interface 602. Processor 606 can modify the display of output interface 602 based on the symbols stored in memory or other inputs. Sensor interface 604 can receive signals from or more piezoelectric (touch), proximity, electro-conductive, or other sensors configured to detect a user interaction with switch 100. In one embodiment, a sensor can be a simple push button arranged at a top, or side of switch 100". Alternatively, sensor can be incorporated within a screen for example, the screen can be a touchscreen. In embodiments, switch 100 can further comprise a beeper, speaker, vibrating motor, or other component capable of producing audio or haptic output to a user.

In one embodiment, sensor interface 604 can receive an input from a user, which can instruct processor 606 to update screen via output interface 602. For example, a user can hold a finger on the tip (or screen) for a predetermined amount of time to activate the sensor. Once activated, switch 100 can produce a beep, or change the display on the screen, or the display state of illuminating element 500. Further presses or other inputs from the user can cause the letters and colors displayed on the screen to change. After the selections are made the sensor can be deactivated, so that the display does not change based on further brief sensor inputs (such as a user walking past a proximity sensor).

In embodiments, communications interface 610 can enable switch 100 to be externally controlled, for example, through a mobile phone, computer, or other application. The application can be cloud based, such that communications interface 610 can provide a connection between switch 100 and an external internet service. In embodiments, the application can also communicate locally, via Bluetooth, Wi-Fi, or other short range communications protocols.

The control application can enable the selection of more complex or varied symbols the screen or configure the display states of illuminating element 500. For example, the control application can enable users to select Unicode characters such as emojis, bitmaps, videos, or other images for display. The control application can enable the user to directly modify the display of one or more switches 100 simultaneously. In addition, the control application can enable the user to modify the set of available symbols (that can be selected via sensor inputs directly to the switch), so that a more limited subset is displayed on the switch itself.

Various embodiments of switch 100 can enable users to modify the label displayed on an electrical switch without having to replace interchangeable tiles. In addition, embodiments including sensors can enable the user to modify the display without the need for an external device (such as a mobile phone).

In embodiments, rocker 200 and tile assembly 300 can be constructed of hard plastic or other material suitable to allow operation of switch 100. In embodiments, all or parts of rocker 200 and tile assembly 300 can be opaque, translucent, or transparent, in order to allow light emitted from illuminating element 500 to be seen through all or a portion of rocker 200 and tile assembly 300. Switch body 102 can be constructed of a variety of materials as are generally known in the art for the construction of electrical switches.

While switch 100 has been depicted and described as a rocker switch, in embodiments of the present disclosure switch 100 can be configured as a toggle switch, dimmer switch, push button switch, or other electrical switch configuration known in the art.

In embodiments, one or more switches 100 can be provided in a kit comprising multiple interchangeable tile assemblies 300 or labels 304, such that the identifier 302 displayed on switch 100 can be selected before or after the switch is installed. For example, in one embodiment, a kit can comprise a single switch 100, or rocker 200, and multiple labels 304. In embodiments, a kit can comprise multiple switches arranged in a gang panel configuration (such as a one-, two-, three-, or higher gang switch) and multiple identifiers.

In embodiments, labels 304 can be provided in sets based on commonly grouped switch types. For example, a set can include identifiers for common household rooms such as kitchen, living room, dining room, and bedroom. Other sets can include identifiers for example, for overhead lights, floor lights, or audio appliances. Labels 304 can further be provided in sets corresponding to the alphabet of the English language (or other languages), Arabic numbers (1-10) or with a combination of colors, patterns, shapes or other designs.

In use, label 304 can provide an identifier related to the electrical circuit controlled by switch 100, such that the user can more easily distinguish the purpose of multiple switches 100 within a single area. Tile assembly 300 can comprise a push button, such that illuminating element 500 is activated only after the user interacts with switch 100 by pushing tile assembly 300.

Figure 5A:
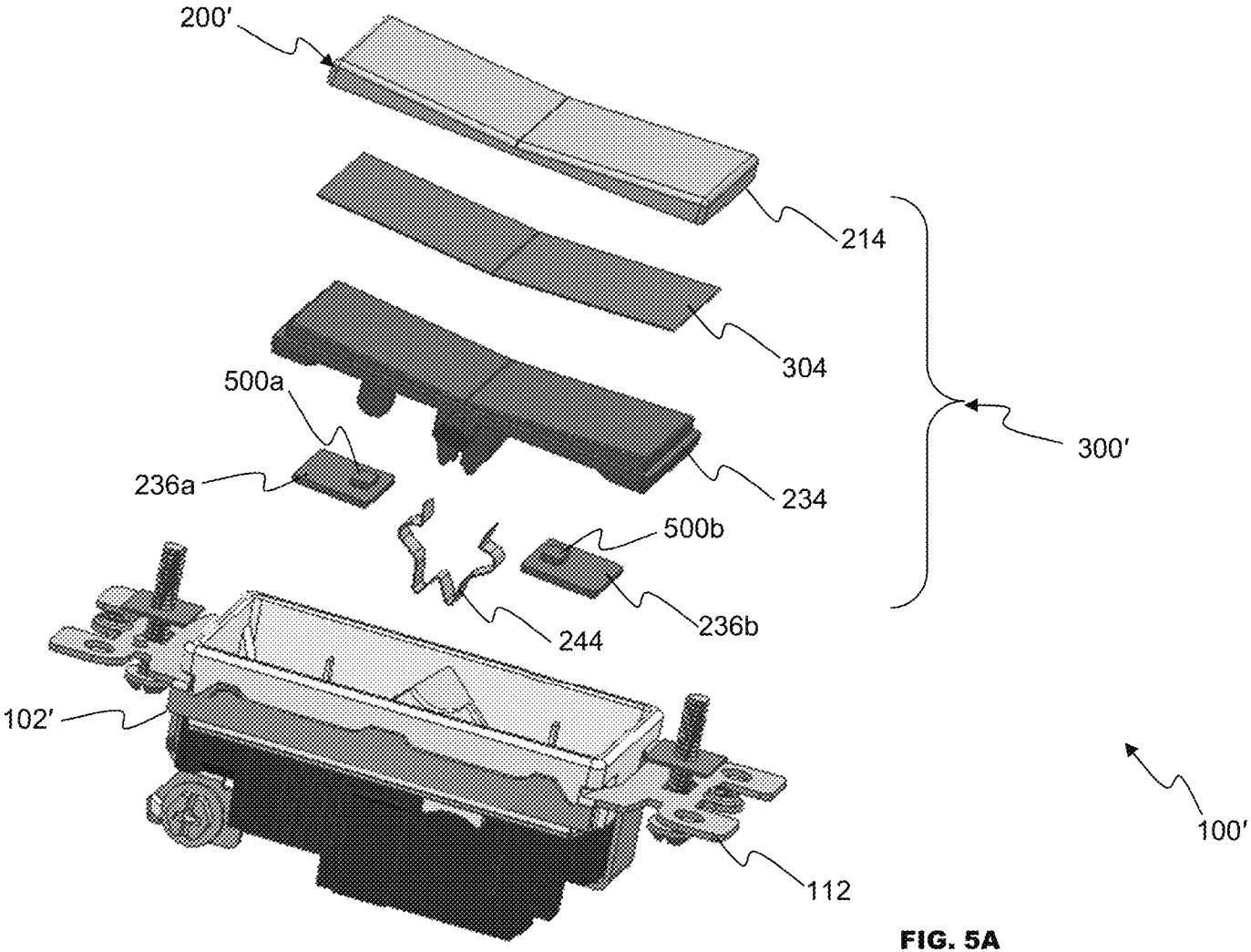
FIG. 5A is an exploded perspective view depicting a rocker switch, according to an embodiment.
Figure 5B:
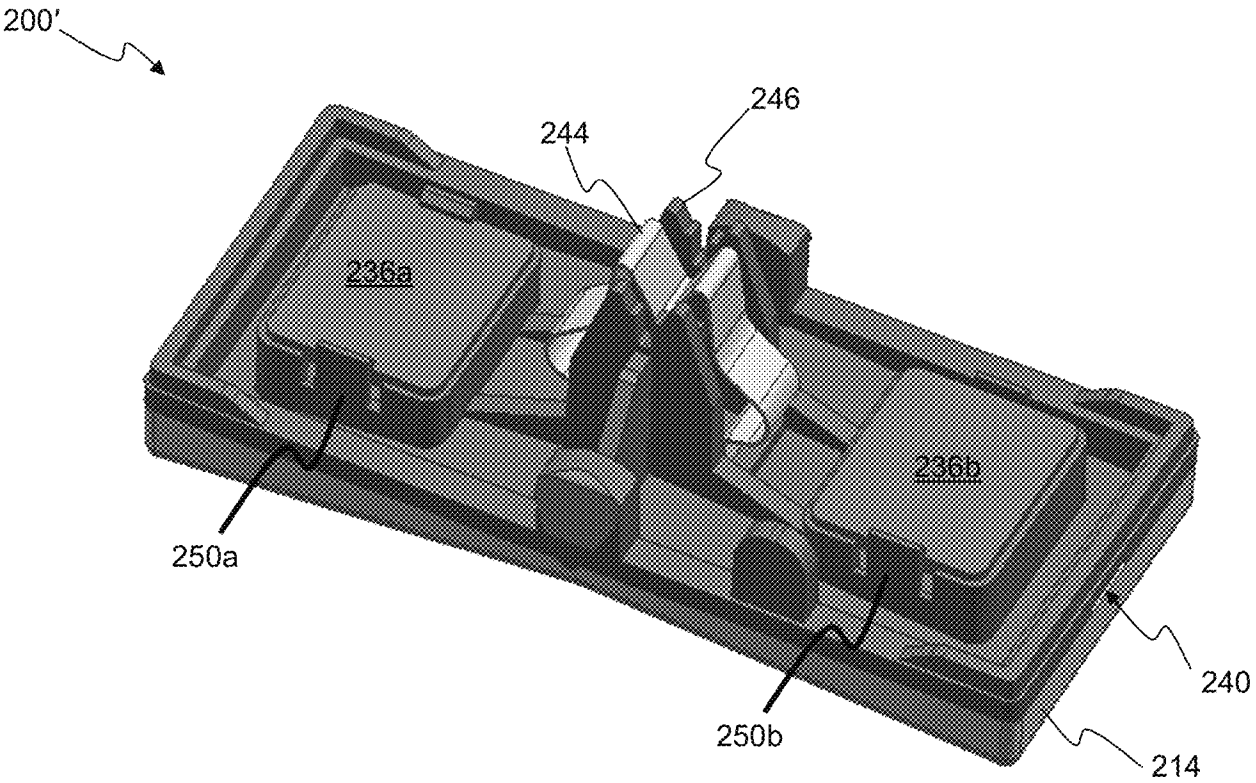
FIG. 5B is a perspective view depicting components of the rocker switch of FIG. 5A.

FIGS. 5A and 5B depict an alternative embodiment of rocker switch 100'. Rocker switch 100' include the same or similar components as the various embodiments of switch 100 discussed above, with rocker 200 and its components replaced by rocker 200'. Similar components are therefore not necessarily repeated herein with respect to rocker switch 100'. As with switch 100, various embodiments of rocker switch 100' can have general dimensions and outward appearance similar to rocker switches known in the art.

Rocker 200' can be integrated into interchangeable tile assembly 300' such that rocker 200' and cover 214 are a singular unit. Interchangeable tile assembly 300' can comprise a plurality of accessory boards 236, such as accessory boards 236*a* and 236*b* as depicted. Each of accessory boards 236*a* and 236*b* can comprise illuminating element 500*a* and 500*b*, respectively. Rocker 200' can comprise receivers 250*a* and 250*b*. Each receiver 250 can be comprised to removably engage a respective one of accessory board 236. Each of accessory boards 236*a* and 236*b* and illuminating elements 500*a* and 500*b* can have similar configurations and functionality as described above with respect to accessory board 236 and illuminating element 500*b* above. Light pipe 234 can be a singular unit, as depicted, or multiple light pipes 234 can be provided to separate light from illuminating elements 500*a* and 500*b* accordingly. Label 304 can similarly extend across light pipe 234, or comprise one or more separate labels 304, each including user-comprisable identifiers or other visual elements.

In one embodiment, the switch 100 and/or its components or subsystems can include computing devices, microprocessors, modules and other computer or computing devices, which can be any programmable device that accepts digital data as input, is configured to process the input according to instructions or algorithms, and provides results as outputs. In one embodiment, computing and other such devices discussed herein can be, comprise, contain or be coupled to a central processing unit (CPU) configured to carry out the instructions of a computer program. Computing and other such devices discussed herein are therefore configured to perform basic arithmetical, logical, and input/output operations.

Computing and other devices discussed herein can include memory. Memory can comprise volatile or non-volatile memory as required by the coupled computing device or processor to not only provide space to execute the instructions or algorithms, but to provide the space to store the instructions themselves. In one embodiment, volatile memory can include random access memory (RAM), dynamic random access memory (DRAM), or static random access memory (SRAM), for example. In one embodiment, non-volatile memory can include read-only memory, flash memory, ferroelectric RAM, hard disk, floppy disk, magnetic tape, or optical disc storage, for example. The foregoing lists in no way limit the type of memory that can be used, as these embodiments are given only by way of example and are not intended to limit the scope of the disclosure. In one embodiment, the system or components thereof can comprise or include various modules or engines, each of which is constructed, programmed, configured, or otherwise adapted to autonomously carry out a function or set of functions. The term "engine" as used herein is defined as a real-world device, component, or arrangement of components implemented using hardware, such as by an application specific integrated circuit (ASIC) or field programmable gate array (FPGA), for example, or as a combination of hardware and software, such as by a microprocessor system and a set of program instructions that adapt the engine to implement the particular functionality, which (while being executed) transform the microprocessor system into a special-purpose device. An engine can also be implemented as a combination of the two, with certain functions facilitated by hardware alone, and other functions facilitated by a combination of hardware and software. In certain implementations, at least a portion, and in some cases, all, of an engine can be executed on the processor(s) of one or more computing platforms that are made up of hardware (e.g., one or more processors, data storage devices such as memory or drive storage, input/output facilities such as network interface devices, video devices, keyboard, mouse or touchscreen devices, etc.) that execute an operating system, system programs, and application programs, while also implementing the engine using multitasking, multithreading, distributed (e.g., cluster, peer-peer, cloud, etc.) processing where appropriate, or other such techniques. Accordingly, each engine can be realized in a variety of physically realizable configurations, and should generally not be limited to any particular implementation exemplified herein, unless such limitations are expressly called out. In addition, an engine can itself be composed of more than one sub-engines, each of which can be regarded as an engine in its own right. Moreover, in the embodiments described herein, each of the various engines corresponds to a defined autonomous functionality; however, it should be understood that in other contemplated embodiments, each functionality can be distributed to more than one engine. Likewise, in other contemplated embodiments, multiple defined functionalities may be implemented by a single engine that performs those multiple functions, possibly alongside other functions, or distributed differently among a set of engines than specifically illustrated in the examples herein.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. An electrical switch to control an electrical circuit comprising:

a switch body including a first terminal for electrical connection to a first lead of the electrical circuit and a second terminal for electrical connection to a second lead of the electrical circuit;

a rocker pivotable between a first position and a second position such that the electrical circuit is energized when the rocker is in the first position and deenergized when the rocker is in the second position, the rocker defining an aperture;

a cover arranged within the aperture such that a front surface of the cover is viewable by a user;

an interchangeable label arrangeable proximate a rear surface of the cover;

a light pipe arrangeable proximate a rear surface of the interchangeable label;

a tactile switch arranged proximate a rear surface of the light pipe, such that the tactile switch can be activated by an application of rearward pressure to the cover;

an illuminating element comprising a tri-color light-emitting diode (LED); and a controller in electrical communication with the tactile switch and the LED and configured to change a display state of the LED in response to activation of the tactile switch.

2. The electrical switch of claim 1, wherein changing the display state of the LED comprises one or more of: changing a color of the LED, changing a light intensity of the LED, or changing a flash rate of the LED.

3. The electrical switch of claim 1, wherein the interchangeable label comprises a user-comprisable identifier on a front surface of the interchangeable label, such that the interchangeable label indicates a property of the electrical circuit controlled by the electrical switch.

4. The electrical switch of claim 1, further comprising a conductive trace electrically coupling the illuminating element to the electrical circuit controlled by the electrical switch, such that the illuminating element is powered by the electrical circuit.

5. The electrical switch of claim 1, further comprising a power source independent of the electrical circuit, such that the illuminating element is powered by the power source.

6. The electrical switch of claim 1, wherein the interchangeable label at least partially comprises a light-transmitting material, such that a light generated by the illuminating element can be seen at a front surface of the interchangeable label.

7. The electrical switch of claim 1, wherein the rocker comprises an opaque material, such that a light generated by the illuminating element cannot be seen through the rocker.

* * * * *